US005125193A

United States Patent [19]

Beaulieu

[11] Patent Number: 5,125,193

[45] Date of Patent: Jun. 30, 1992

[54] FOLDABLE PANEL DISPLAY SYSTEM

[75] Inventor: Bryan J. Beaulieu, Burnsville, Minn.

[73] Assignee: Skyline Displays, Inc., Burnsville, Minn.

[21] Appl. No.: 621,511

[22] Filed: Dec. 3, 1990

[51] Int. Cl.[5] ..... E04C 2/38; E04C 2/36; E04C 2/32; A47G 5/00

[52] U.S. Cl. ..... 52/71; 52/239; 52/582; 52/716; 52/792; 52/808; 52/829; 160/135; 160/231.2; 160/233

[58] Field of Search ..... 52/71, 239, 38, 583, 52/582, 792, 808, 829, 716; 160/231.1, 231.2, 232, 233, 135, 351

[56] References Cited

U.S. PATENT DOCUMENTS

| | | | |
|---|---|---|---|
| 3,871,153 | 3/1975 | Birum, Jr. | 52/239 |
| 3,913,656 | 10/1975 | Guyer | 160/351 |
| 4,436,135 | 3/1984 | Ytter | 160/135 |
| 4,722,146 | 2/1988 | Kemeny | 160/135 |
| 4,830,080 | 5/1989 | Densen | 160/351 |
| 4,924,931 | 5/1990 | Miller | 160/135 |

FOREIGN PATENT DOCUMENTS

| | | | |
|---|---|---|---|
| 2060022 | 4/1981 | United Kingdom | 52/239 |

*Primary Examiner*—Michael Safavi
*Attorney, Agent, or Firm*—Palmatier & Sjoquist

[57] ABSTRACT

A graphic display panel system formed in sections, wherein a graphic display image may be affixed to each section, the sections respectively having transparent edge caps and/or hinge connectors and/or locking pin assemblies for selectively interconnecting the sections to form an overall surface. The individual panel sections may be formed of a lightweight honeycomb structure or spaced apart plastic sheets.

13 Claims, 5 Drawing Sheets

FOLDABLE PANEL DISPLAY SYSTEM

BACKGROUND OF THE INVENTION

The present invention relates to a foldable panel display system; more particularly, the invention relates to a system of panels which may be selectively hinged along one or more of their edges, for being hingedly connected to adjacent panels of a similar type. The surfaces of the panels are adapted for adhering to segments of graphic images, photographs, or fabric material.

In the field of exhibition display systems it is desirable to provide display devices which are portable in nature, and which may be used to display photographic or other graphic display media. The need for portability dictates that a display system be easily assembled and disassembled, and that it be readily transportable in a relatively small package. The need for providing a graphic display media dictates that the display system itself not detract from the graphics it is displaying, and that the media interfere as little as possible with the overall graphics being displayed. These two needs often compete with one another, for in order to provide a portable display structure it is usually necessary to arrange the structure in sections of one type or another, and the joining structure of adjacent sections often interfere with and/or obstruct the graphics images which are portrayed thereon. This is particularly true in the case of large portable exhibit display panels, which frequently are arranged in rectangular or square sections which are held together by some form of framework, and the framework itself interferes with the continuity of the display panel surface. Display panels which exhibit very large graphic illustrations or photographs tend to obscure the continuous graphic images presented thereon by the presence of the various frames and assemblies which hold the graphic panels together.

There is a need to provide a portable graphic display panel system which has the capability of presenting very large graphic images over a display panel surface, even though the display panel surface itself may be arranged in sections which may be assembled and/or disassembled for portability. There is a particular need for a display panel system which enables the display of very large photographic images, arranged in sectional segments, with a minimum of visual interference caused by the section joining apparatus. The present invention provides such a system.

SUMMARY OF THE INVENTION

A portable exhibit display system formed of a plurality of panels, wherein the respective panels may be hingedly interconnected along adjacent edges, or engaged with pin locking devices, and wherein the respective panel surfaces are adapted for affixing to graphic images applied to paper, cloth, or other sheet materials. The hinged and interlocking relationship of the respective panels enables the display system to be arranged in an infinite number of combinations, while presenting continuous graphic images across the overall display surface. The invention includes a novel edging and hinge connector for attachment to respective panels, to provide a transparent hinge assembly which does not obstruct the graphic images affixed to the panels.

It is therefore a feature and advantage of the present invention to provide a portable display system constructed of a plurality of sections, wherein the sections may be assembled to present a continuous graphic image over the entire panel surface.

It is another feature and advantage of the present invention to provide a portable display panel wherein the panel sections may be readily assembled and disassembled, and may be transported in relatively small packages.

It is a further feature and advantage of the present invention to provide display panel sections which can accommodate photographic or other images across the entire panel section surface.

It is a further feature and advantage of the present invention to provide a portable display panel system having lightweight construction, and being readily adaptable for changing and/or replacing the graphic images presented on the respective panel sections.

The foregoing and other advantages and features of the invention will become apparent from the following specification and claims, and with reference to the appended drawings.

DESCRIPTION OF THE PREFERRED EMBODIMENT

Figure 1:
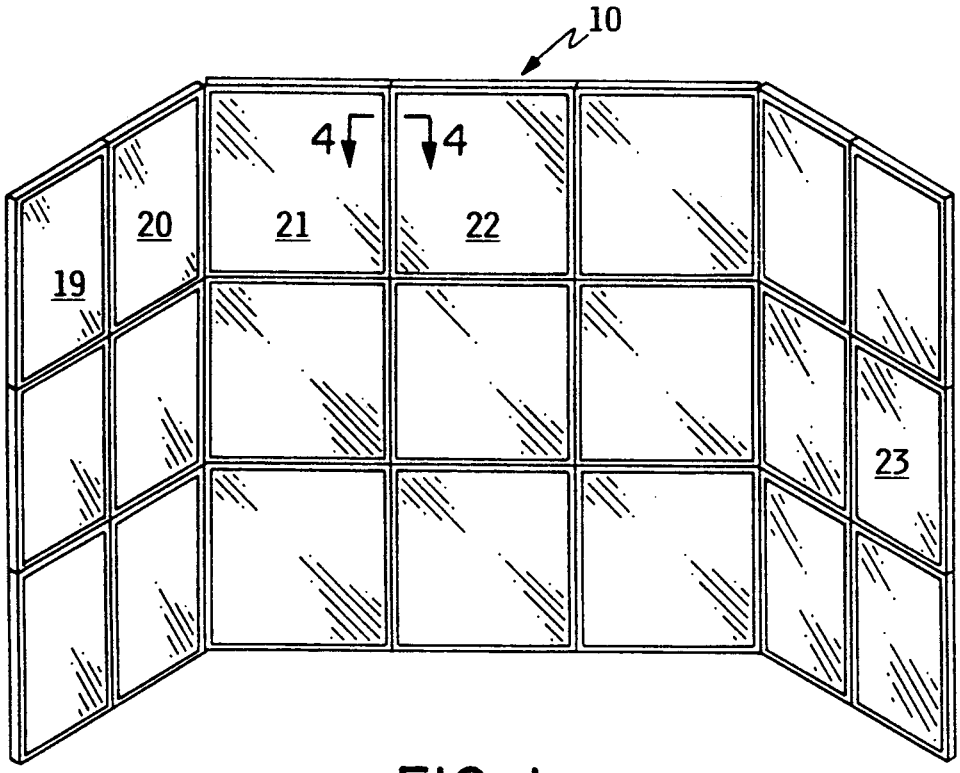
FIG. 1 shows an isometric view of the portable exhibit panel system.

Referring first to FIG. 1, there is shown an isometric view of the display panel system 10. System 10 comprises a plurality of sections such as sections 19, 20—23, which are identical in all respects except for the particular edge materials applied to the sections, and the respective hinges and/or pin interlocking devices. The edge materials applied to a section are dependent upon the relative position of the section within system 10, and are also dependent upon whether a section is to be hingedly connected to any adjacent section. For example, section 22 has a top edge which is merely an edge cap, and one or more of its interior edges may be formed with an edge cap or an edge hinge of the type to be hereinafter described. The exposed surfaces of any or all of the sections of system 10 may be covered with fabric material, graphics material, or photographic material. In a typical display environment, system 10 may have an overall width of up to or exceeding 10 feet, and may have an overall height of 6–8 feet, and individual sections may preferably be squares of 12″—30″ in size, or rectangles, triangles or other geometric shapes of greater or lesser size.

Figure 2:
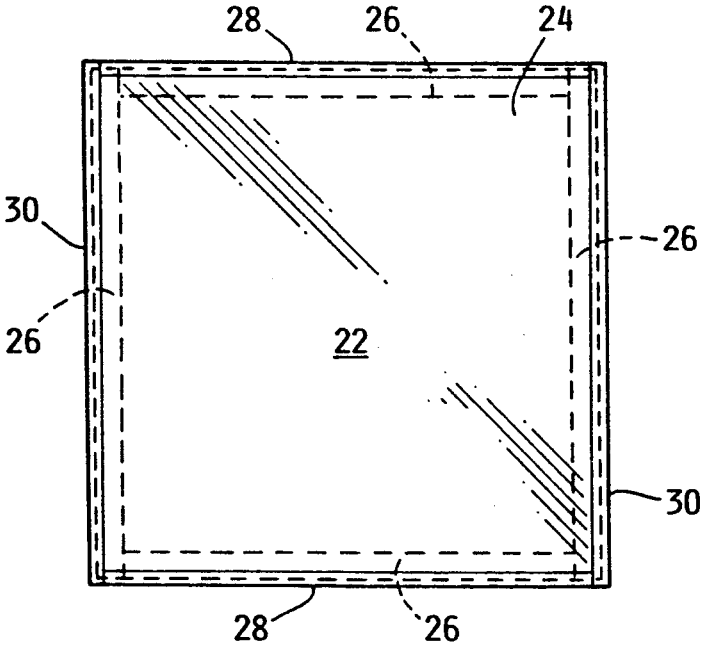
FIG. 2 shows an elevation view of a panel section.

FIG. 2 shows an elevation view of a typical section 22. Typical section 22 is preferably formed of a rectangular or square section 24 of board, in the form of foamed plastic, or honeycombed material, or equivalent. It is preferred that a honeycomb core be utilized, typically having a thickness of approximately ½ inch, because this material is both sturdy and lightweight for handling. The peripheral edges of honeycomb core 24 have extruded plastic channels 26 affixed thereto, in a manner to be hereinafter described. Each of the channels 26 may have a slidable cap 28 attached thereon, or a slidable hinge 30 similarly attached thereon, both in a manner to be hereinafter described. The flat surface areas of section 22 may be coated with a semi-sticky adhesive material, for purposes of adhering to paper, fabrics or the like, as will be hereinafter described.

Figure 3:
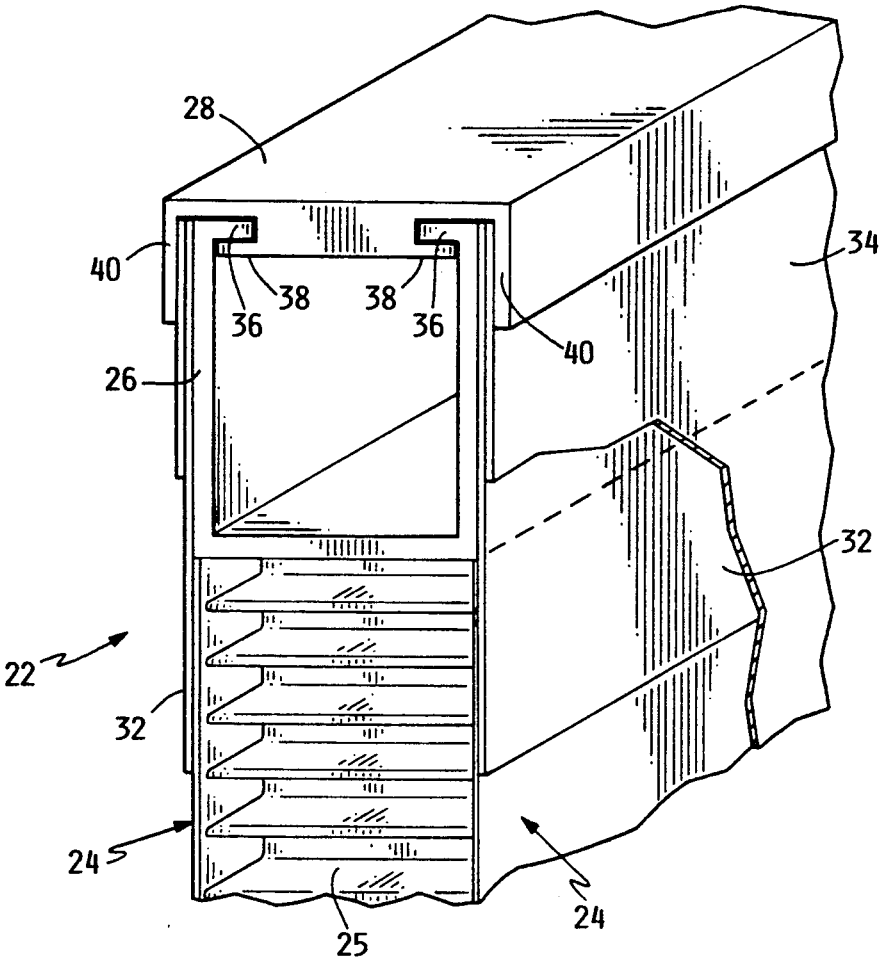
FIG. 3 shows an isometric view of an exploded edge portion of a panel section.

FIG. 3 shows an exploded partial view of an edge region of section 22. The core material is preferably formed utilizing a paper honeycomb center section 25 which is affixed between two outer surfaces 24. An edge extrusion 26, preferably formed of plastic, is affixed against an edge of the honeycomb core material 25, by adhesive strips 32 applied across the outer surfaces of edge extrusion 26 and extending for a distance along the outer surfaces 24 of the honeycombed material. Edge extrusion 26 has an enlarged interior opening, and a pair of engagement tabs 36 which are inwardly directed. Edge extrusion 26 is preferably formed of ABS plastic or the like.

An edge cap 28 is slidably fitted over edge extrusion 26, by means of a pair of keyways 38 which slidably engage about engagement tabs 36 of edge extrusion 26. Edge cap 28 may be slidably applied from either end of edge extrusion 26. Edge cap 28 has a pair of outer edge covers 40, which overlay a portion of a graphic image 34 applied to paper or the like, to perform a protective edging for the graphic material. Edge cap 28 is preferably formed in an extrusion process of a rigid clear plastic, such as Polyvinyl Chloride, and is therefore transparent. The transparency of outer edge cover 40 permits the graphic image 34 to be viewed through outer edge cover 40, and therefore the graphic image is not obscured, even though it is applied to the edges of the surface of the core. The surface is preferably coated with a semi-sticky adhesive to adhere to the image 34.

Figure 4A:
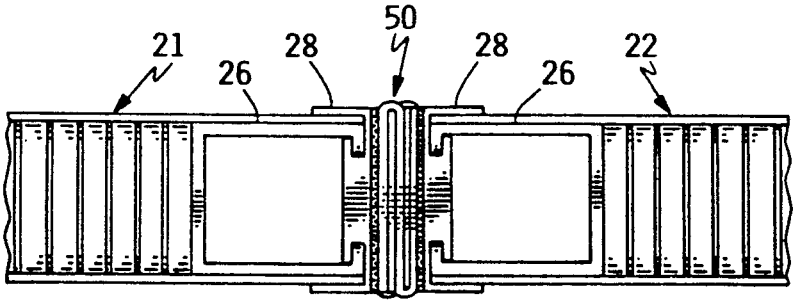
FIGS. 4A, 4B and 4C show adjacent panel sections in three different hinged relationships.
Figure 4B:
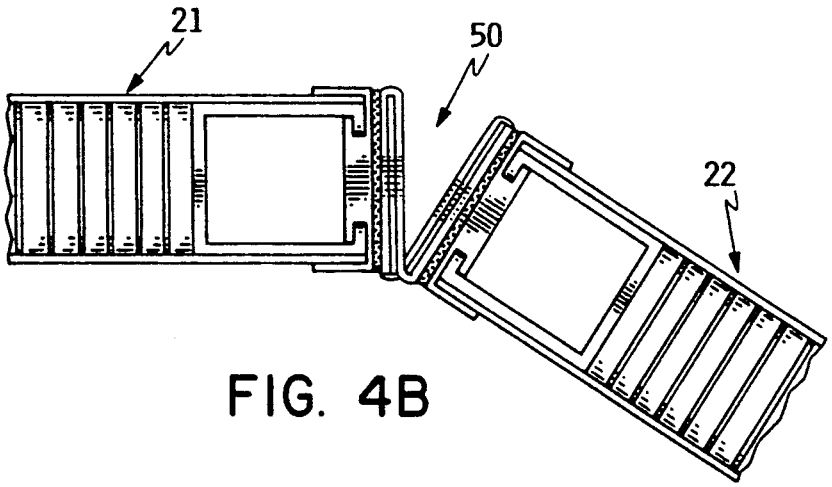
Figure 4C:
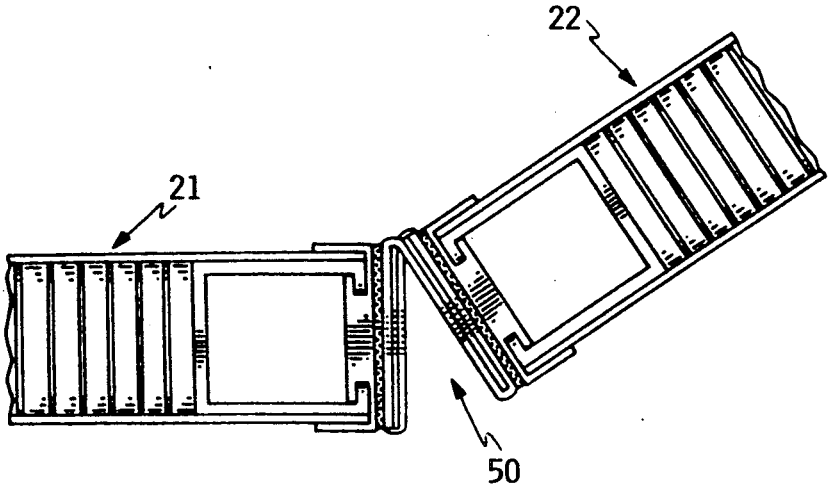

Another form of edging which may be applied to a panel section is a hinge connector. FIGS. 4A–4C show cross-section views of enlarged portions of adjacent edge sections having a hinge connector attachment therebetween, as for example the hinge connector which is revealed by a cross-sectional view taken along the lines 4—4 of FIG. 1. FIG. 4A shows adjacent panel sections 21 and 22 aligned in a straight-line, edge-to-edge configuration. The respective edge extrusions 26 and edge caps 28 are in facing relationship, and a hinge 50 is affixed to the respective top surfaces of adjacent edge caps 28. FIG. 4B shows the same view with panel sections 21 and 22 hinged inwardly to form a hinged joint of panel system 10. FIG. 4C shows the same view with panel sections 21 and 22 turned outwardly to form an outward hinged joint of panel system 10. In each case, hinge 50 permits the respective movement and positions which are illustrated in FIGS. 4A–4C.

Hinge 50 is constructed by a process of layering successive strips of plastic, according to the technique illustrated in FIGS. 5A–5F. Initially, a die-cut piece of plastic 52 is formed having a plurality of alternatively extending tabs 61, 62, 63, 64, 65, 66, . . . . The tabs are alternately spaced on either side of a center region 60. Plastic piece 52 is preferably formed of 0.005 inch thick transparent polypropylene plastic. The tabs are typically about 1 inch in width, and have a length slightly in excess of 1 inch. The spacing between tabs is also approximately 1 inch, although it is advantageous to make the tabs slightly narrower than the intertab spacing.

In addition to the die-cut piece 52, hinge 50 requires a pair of identical plastic strips 54*a*, 54*b*, which form plastic spines which are interconnected with the tabs of die-cut piece 52. The plastic strips 54*a*, 54*b* are preferably formed of 0.020 inch thick transparent Lexan material, approximately equal in width to region 60.

Figure 6:
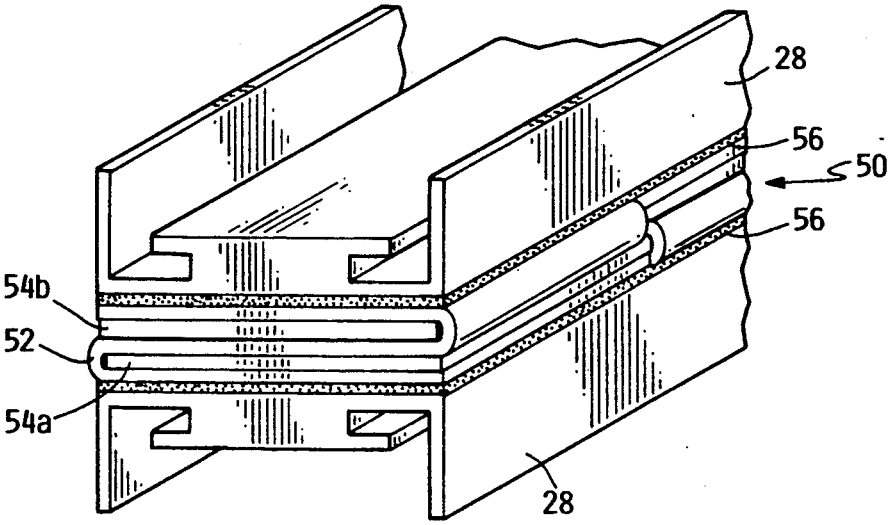
FIG. 6 shows an isometric view of a portion of an assembled hinge.
Figure 5A:
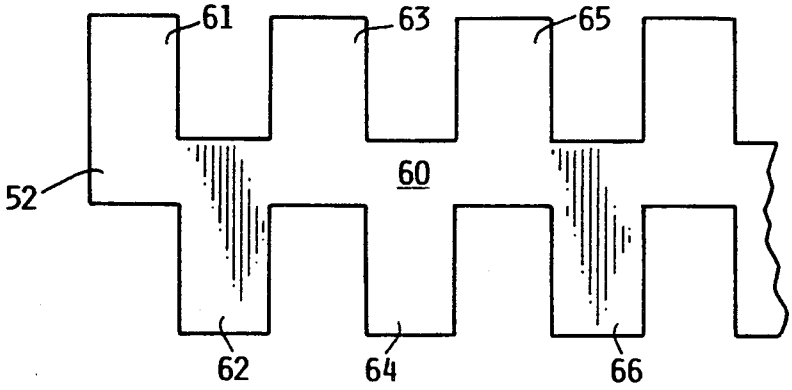
FIGS. 5A–5F show the steps of assembly of the hinge of the present invention.
Figure 5B:
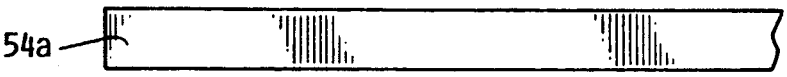
Figure 5C:
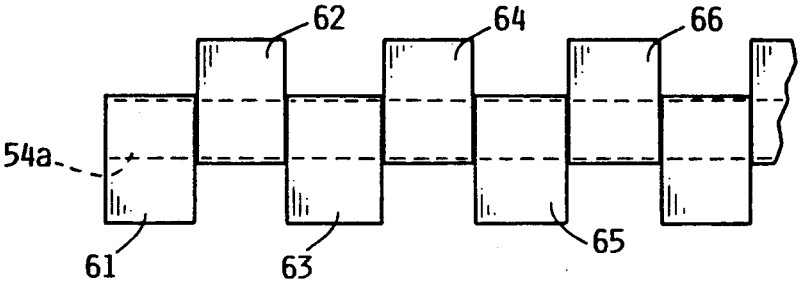
Figure 5D:
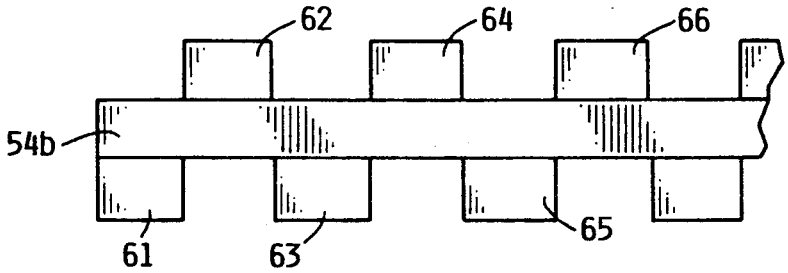
Figure 5E:
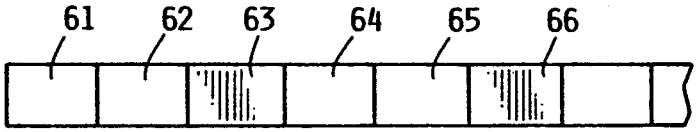
Figure 5F:
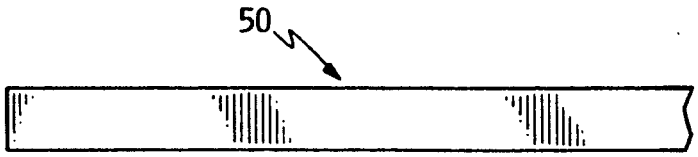

After the die-cut strip 52 is formed, a transparent plastic strip 54*a* (FIG. 5B) is adhesively affixed along the center line of die-cut piece 52, covering region 60. Each of the tabs are respectively folded over the plastic strip 54*a* as illustrated in FIG. 5C, to form a partial assembly comprising a first plastic strip 54*a* having a plurality of tabs overlaying its top surface. Next, a second plastic strip 54*b* is overlaid over the assembly of FIG. 5C, to form the partial assembly of FIG. 5D. The top surface of plastic strip 54*b* is coated with adhesive, and the respective tabs are folded over strip 54*b*, to form the assembly of FIG. 5E. Finally, a double-sided adhesive tape is applied along both exterior surfaces of the assembly of 5E, to form the completed hinge assembly 50 of FIG. 5F. The adhesive tape along each external strip surface is then applied to an edge cap 28 to secure the hinge 50 intermediate to adjacent edge caps. An enlarged isometric view of such a construction is shown in FIG. 6, wherein a hinge 50 is adhesively affixed between two edge caps 28 by means of adhesive tape materials 56. The finished hinge assembly may be slidably engaged with mating edge extrusion strips 26, to apply the hinge 50 between any two or more panel sections.

Figure 8:
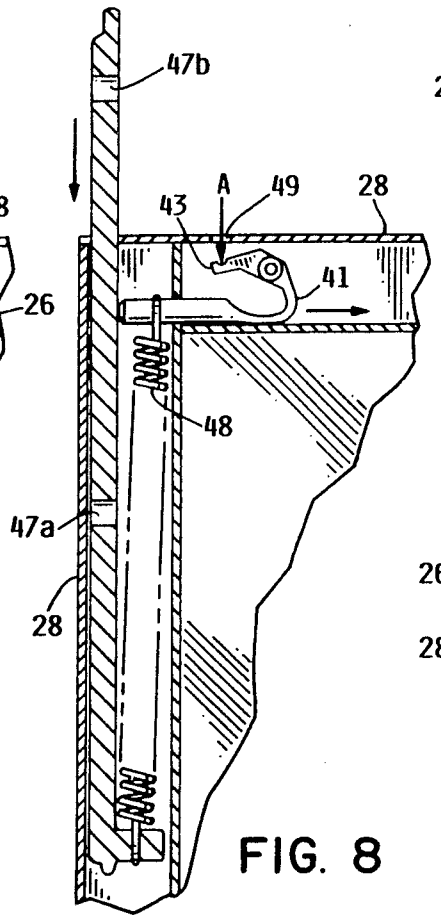
FIG. 8 shows the pin interlocking device of FIG. 7 in a retracted position.
Figure 7:
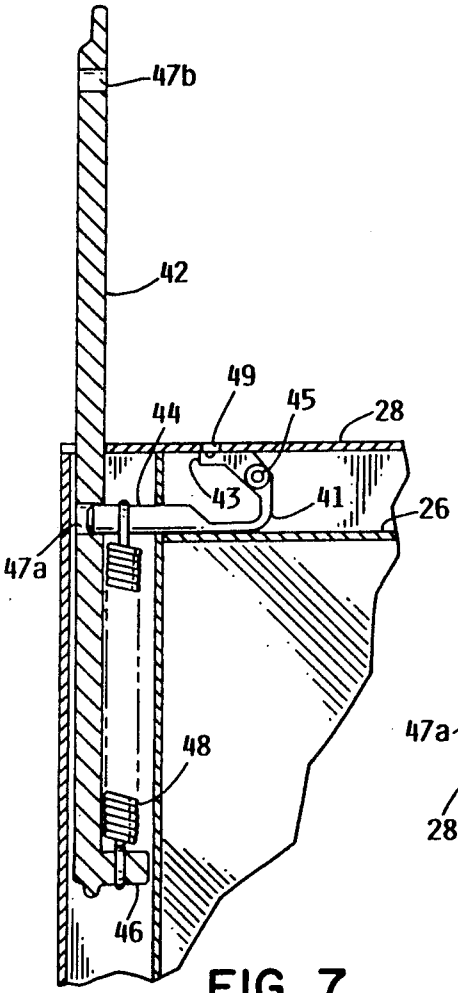
FIG. 7 shows a cross-section view of a pin interlocking device.

FIGS. 7 and 8 show a pin locking mechanism which may be used with the present invention, to interlock adjacent panel sections. A slidable locking pin 42 is fitted into the channel within an edge extrusion 26. Locking pin 42 is spring biased by an extension spring 48 which is attached at its top end to slidable bolt 44, and is attached at its bottom end to a tab 46 projecting from locking pin 42. Slidable bolt 44 is fitted into the edge extrusion 26 channel adjacent to locking pin 42. Bolt 44 is formed of a resilient plastic material and is attached to a pivot pin 45 in the channel. An opening 49 through edge cap 28 exposes an end 43 of bolt 44. The forward end of bolt 44 is sized to fit within a detent slot 47*a* or 47*b* found in locking pin 42.

The locking pin mechanism may be disengaged by depressing bolt end 43 in the direction of arrow A which deforms the resilient curved section 41 and causes bolt 44 to pivot rearwardly, as shown in FIG. 8. Locking pin 42 may then be pushed into the channel until bolt 44 engages detent slot 47*b*. Locking pin 42 can be released by depressing bolt end 43, thereby sliding bolt 44 rearwardly, and permitting spring 48 to push locking pin 42 outwardly until it becomes engaged by bolt 44 in detent 47*a*. In this position, locking pin 42 is available for insertion into an edge extrusion 26 opening of an adjacent panel section.

A suitable number of locking pin assemblies are used in combination with hinge assemblies, to design a panel system 10 whereby a certain number of panel sections may be hingedly folded together for storage, and whereby adjacent groups of hinged panel sections may be interlocked by using the locking pin assemblies. Locking pin assemblies and hinges are adaptable for mounting in either a horizontal or vertical direction, and the combinations of such assemblies which are selected are dependent upon the particular design requirements of a panel system 10.

Figure 9:
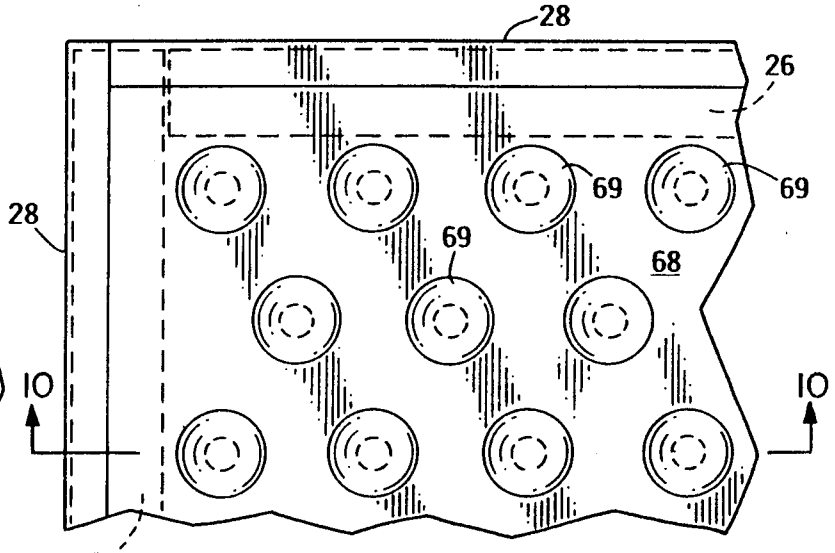
FIG. 9 shows a partial elevation view of an alternate form of panel section.
Figure 10:
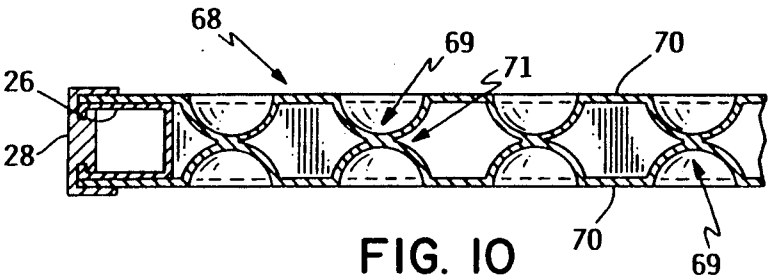
FIG. 10 shows a view taken along the lines 10-10 of FIG. 9.

FIG. 9 shows an alternate form of panel sections, wherein the honeycomb core is replaced by a formed core 68, preferably made from Lexan or similar plastic materials. The formed core 68 has a plurality of recessions or dimples 69 which extend inwardly from an outer surface, as best illustrated in the cross-section view of FIG. 10. The depression 69 may be formed in a sheet 70 at regularly spaced intervals, and two sheets 70 may be fitted together in opposing relationship as shown in FIG. 10. The inner ends of respective adjacent depression 69 may be adhered together as shown at 71, either by a heating process or by use of adhesive materials, thereby forming a solid core structure. The outer edges of sheets 70 may be adhesively attached to edge extrusion strips 26, and edge caps 28 may be fitted over extrusion edges 26 as hereinbefore described. The structure of FIGS. 9 and 10 also forms a rigid, lightweight core assembly for use in the paneled section, in a manner which is equally satisfactory to the honeycomb core structure earlier described. If desired, an outer covering sheet may be overlaid over dimpled sheets 70, to form a base surface for adhering to paper or fabric sheets in a manner previously described.

In operation, the display system 10 is laid out to select the respective hinge joints and locking pin assemblies which will be used along adjacent panel section lines. The hinges 50, attached to edge caps 28, may then be slidably affixed to the respective panel section edges 26 to form these hinged sections, and locking pin assemblies may be installed in appropriate edge extrusions 26. Edge caps 28 may be slidably engaged along all other edges of panel sections, although it is preferred that the graphic and/or photographic display materials be affixed to the panel section surfaces prior to affixing the edge caps 28. The edge caps 28 provide a protective transparent plastic edge about the entire periphery of every panel section, thereby to protect the graphic and/or photographic image overlaid on the panel section surface, without obstructing the view of the image by properly coordinating the respective image sections with panel sections. It is possible to construct a continuous graphic and/or photographic image which appears to continuously cover the entire panel system 10 surface, because the graphic images can be applied to all panel section edges. Furthermore, the same technique may be applied to both overall surfaces of panel system 10, to provide graphic and/or photographic images to both sides of a panel system 10. Alternatively, one surface of panel system 10 may be covered with a fabric material and the other system may be covered with a graphic and/or photographic image. The respective hinge joints may be applied at selective spacing as is illustrated in FIG. 1, to provide a panel system 10 which is freestanding and without requiring any other support mechanism.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A graphic display panel system formed of a plurality of interconnected sections, comprising a) a plurality of sections of board material, each section having an adhesive surface for affixing to a sheet material, and each section having peripheral edges with means for attachment to a first or second edge strip comprising a plastic extrusion having an interior channel between spaced-apart walls, the distal edges of said walls being formed into inwardly-directed engagement tabs;

b) a first edge strip of transparent plastic material having means for engagement with said means for attachment comprising a pair of longitudinal keyways sized for slidably fitting about said engagement tabs, and having a lip for overlapping an edge of said adhesive surface; and c) a second edge strip of transparent plastic material having a pair of means for engagement with said means for attachment each having a lip for overlapping an edge of said adhesive surface, said second edge strip further having a longitudinal hinge strip intermediate said pair.

2. The system of claim 1, wherein said board material further comprises a central honeycomb section and outer sheet surfaces.

3. The system of claim 1, wherein said board material further comprises a pair of plastic sheets, each sheet having a plurality of regularly spaced depressions, said sheets being aligned with said depression in facing relationship and affixed together.

4. The system of claim 1, wherein said second edge strip means for engagement further comprises a pair of longitudinal keyways sized for slidably fitting about said engagement tabs.

5. The system of claim 4, wherein said second edge strip longitudinal hinge strip further comprises a double hinge having means for hinging in two directions about said longitudinal strip.

6. The system of claim 5, wherein said longitudinal hinge strip further comprises a first flexible sheet having a center section and alternately spaced tabs on either side of said center section, a first strip said alternately spaced tabs folded over an upper surface of said first strip, a second strip overlaying said folded alternately spaced tabs, and said tabs being further folded over and adhesively attached to an upper surface of said second strip.

7. The system of claim 6, wherein all of said first flexible sheet, said first and second strips are made from transparent plastic material.

8. A graphic display panel system formed of a plurality of interconnected sections, comprising a) a plurality of sections of board material, each section having an adhesive surface for affixing to a sheet material, and each section having peripheral edges with means for attachment to a first or second edge strip comprising a plastic extrusion having an interior channel between spaced-apart walls, the distal edges of said walls being formed into inwardly-directed engagement tabs;

b) a first edge strip of transparent plastic material having means for engagement with said means for attachment comprising a pair of longitudinal keyways sized for slidably fitting about said engagement tabs, and having a lip for overlapping an edge of said adhesive surface;

c) a second edge strip of transparent plastic material having a pair of means for engagement with said means for attachment each having a lip for overlapping an edge of said adhesive surface, said second edge strip further having a longitudinal hinge strip intermediate said pair;

d) a plurality of locking key assemblies selectively mounted to said sections of board material, each of said assemblies including a retractable pin; and e) channel recesses in said sections of board material, said channel recesses positioned to receive said retractable pin.

9. The system of claim 8, wherein said board material further comprises a central honeycomb section and outer sheet surfaces.

10. The system of claim 8, wherein said board material further comprises a pair of plastic sheets, each sheet having a plurality of regularly spaced depressions, said sheets being aligned with said depressions in facing relationship and affixed together.

11. The system of claim 8, wherein said second edge strip means for engagement further comprises a pair of longitudinal keyways sized for slidably fitting about said engagement tabs.

12. The system of claim 11, wherein said second edge strip longitudinal hinge strip further comprises a double hinge having means for hinging in two directions about said longitudinal strip.

13. A graphic display panel section adapted for displaying graphic image materials in sheet form comprising a) a board-like substrate having a honeycomb interior structure sandwiched between exterior sheets, at least one of said sheets having an exterior adhesive coating;

b) an edge channel affixed about the periphery of said substrate, said channel having an interior recess and engagement tabs running along an outer peripheral edge thereof, said edge channel having a thickness substantially equal to said board-like substrate;

c) a transparent edge cap slidably fitted to the engagement tabs along the peripheral edge of said edge channel, said edge cap having a transparent lip overlying an edge strip of said edge channel; whereby graphic images may be affixed to at least one surface of said board-like structure and may extend to the edge of said board-like structure and be overlaid by said edge cap transparent lip.

* * * * *

UNITED STATES PATENT AND TRADEMARK OFFICE

CERTIFICATE OF CORRECTION

PATENT NO. : 5,125,193

DATED : June 30, 1992

INVENTOR(S) : Bryan J. Beaulieu

It is certified that error appears in the above-identified patent and that said Letters Patent is hereby corrected as shown below:

In column 3, line 20, delete "24"; in column 3, line 25, delete "24";

In claim 9, column 6, line 44, after "strip" insert the following -- adhesively overlaying said center section and having --.

Signed and Sealed this

Sixteenth Day of November, 1993

*Attest:*

*Attesting Officer*

BRUCE LEHMAN

*Commissioner of Patents and Trademarks*